US006166716A

United States Patent [19]

Kashino

[11] Patent Number: 6,166,716

[45] Date of Patent: Dec. 26, 2000

[54] PRESENTATION APPARATUS FOR TWO-DIMENSIONAL PICTURE INFORMATION

[75] Inventor: Yuta Kashino, Mitaka, Japan

[73] Assignees: Dentsu Tec Inc., Tokyo; Planet Computer, Inc., Mishima, both of Japan

[21] Appl. No.: 09/209,223

[22] Filed: Dec. 11, 1998

[30] Foreign Application Priority Data

Dec. 26, 1997 [JP] Japan ..... 9-368069

[51] Int. Cl.[7] ..... G09G 5/34

[52] U.S. Cl. ..... 345/112; 345/113; 345/114; 345/133

[58] Field of Search ..... 345/112, 433, 345/115, 113, 114, 502, 133; 382/232, 276; 380/202, 243; 707/531, 513, 514, 526

[56] References Cited

U.S. PATENT DOCUMENTS

| | | | |
|---|---|---|---|
| 5,129,013 | 7/1992 | Holzmann et al. | 382/276 |
| 5,528,739 | 6/1996 | Lucas et al. | 707/526 |
| 5,612,716 | 3/1997 | Chida et al. | 345/133 |
| 5,710,834 | 1/1998 | Rhoads | 382/232 |
| 5,966,114 | 10/1999 | Ito et al. | 345/113 |
| 5,966,135 | 10/1999 | Roy et al. | 345/433 |
| 6,012,074 | 1/2000 | Lucas et al. | 707/531 |
| 6,028,583 | 2/2000 | Hamburg | 345/112 |

*Primary Examiner*—Matthew Luu
*Assistant Examiner*—Thu-Thao Hawan
*Attorney, Agent, or Firm*—Ladas & Parry

[57] ABSTRACT

A picture to be printed is prepared by DTP software and is stored into layer L0 of the file F which is distributed to respective correctors. The first corrector writes correcting indication K1 onto layer L1, the second corrector writes correcting indication K2 onto the layer L2 and the third corrector writes correcting indication K3 onto the layer L3. For the respective layers, respective passwords are to be set for ensuring securities. In order to display or to edit a specific layer, it is required to input a proper password. Layer information ranging over plural files can be united within a single file and are handled with a unified manner.

7 Claims, 11 Drawing Sheets

PRESENTATION APPARATUS FOR TWO-DIMENSIONAL PICTURE INFORMATION

BACKGROUND OF THE INVENTION

This invention relates to a presentation apparatus for two-dimensional picture information and, more particularly, to an apparatus for presenting information which is distributed and preserved into plural layers located on the same area with overlapping manner.

At present, many kinds of information can be displayed on a display screen of the computer. It is expected that this tendency is further spurred in future by popularization of the internet. In recent years, with improvement of resolution of display, it becomes possible to present considerably fine information. In the car navigation system, etc., a device for presenting a detailed map on a two-dimensional display screen is assembled.

Moreover, by popularization of the so-called DTP (Desk Top Publishing) technology, it has been popularized to carry out editing work by using computer in the field of printing. In the DTP, layout work for characters or photographs to be printed is carried out on the display screen of the computer, and all sorts of information necessary for printing are displayed on the display screen. Further, in recent years, a document format PDF (Portable Document Format) that Adobe Systems Co. Ltd. in the U.S. has announced has been popularized. A picture image to be printed can be stored in a PDF file. When this PDF file is delivered to proofreaders, they can proceed with their correcting work on the display screen.

In the case where very complicated information such as information on a map or various correcting instructions in the DTP, etc. are presented onto a two-dimensional screen, information to be displayed is usually distributed and preserved into plural layers. For example, in the case of information of a map, when a layer including fundamental geographic data such as road or topography, etc. and a layer including particular location data such as particular places of restaurant or home, etc. are separately handled, it is possible to display only a necessary layer as occasion demands. Moreover, in the case of carrying out editing work such as changing the place of home, etc., only a layer to be edited can be selected. Accordingly, such an error that fundamental geographic data of the map is erroneously altered can be prevented. Multiple layers are also convenient in DTP work. When a layer indicating a picture to be printed and a layer indicating editorial instructions are separately managed, the editorial instructions can be clearly distinguished.

As described above, an approach to handle the information in the state delivered into plural layers has a great merit in improving display or editing efficiency in presenting a large number of information onto the two-dimensional screen. However, in the conventional typical presenting device for two-dimensional information, there is a problem that it is difficult to utilize the system with enough security. For example, let consider the case where editorial corrections with respect to the DTP work are carried out on the display screen. In typical commercial printed matters, not only an editor but also plural persons including a designer, a copy writer or a sponsor, etc. participate in the correcting work. Hitherto, such plural persons carry out work for respectively writing instructions for correction onto the picture to be printed. In this case, it is impossible to rigorously recognize the actual relationship between respective persons and respective instructions. For this reason, there was a problem that sufficient security relating to correcting responsibility could not be maintained. If the correction work is carried out on a paper, it is possible to clarify the correcting responsibility by signature of respective correctors. However, when the correction work is carried out on the screen, it is very hard to clarify the correcting responsibility, since signatures are not available on the screen. This was a big problem in business.

Another problem in the conventional device for presenting two-dimensional picture information is that layer information belonging to different files cannot be unified. In general, picture information produced by computer is handled as a file unit. Accordingly, in the case of DTP work on the display screen, if there is employed an approach to send a file in a sequential order to, for example, a designer, a copy writer and a sponsor and to make them write instructions for correction on the same file, such file can be dealt as an only file at all times. However, in many practical instances, another approach is usually employed to duplicate a file, to separately send the duplicated files to a designer, a copy writer and a sponsor and to make them write instructions for correction on the respective individual files by parallel processing. In this case, plural corrected files are finally returned to the editor. Thus, the editor owes the additional work for taking out and gathering necessary correcting information from the respective files.

This invention has been made in order to solve the above-described problem that the conventional device for presenting two-dimensional picture information has. The object of the present invention is to provide a presentation apparatus for two-dimensional picture information which can maintain security for respective layers and handle layers between plural files in unified manner.

SUMMARY OF THE INVENTION (1) The first feature of the invention resides in a presentation apparatus for two-dimensional picture information, comprising:

display means for displaying a predetermined picture in a two-dimensional display area;

memory means for preserving contents to be displayed in the display area as data in a state divided into plural layers; and display control means for reading out data with respect to a designated layer from the memory means in accordance with a layer designation inputted by an operator, preparing a picture to be displayed on the basis of the data which has been read out and delivering the prepared picture to the display means to display it;

wherein the display control means has a function to set a password with respect to a specific layer based on demand of the operator and, when a layer in which the password is set is designated, to display contents of the designated layer in the display area provided that the password is inputted.

(2) The second feature of the invention resides in a presentation apparatus for two-dimensional picture information, comprising:

display means for displaying a predetermined picture in a two-dimensional display area;

memory means for preserving contents to be displayed in the display area as data in a state divided into plural layers;

display control means for reading out data with respect to a designated layer from the memory means in accordance with a layer designation inputted by an operator, preparing a picture to be displayed on the basis of the data which has been read out and delivering the prepared picture to the display means to display it; and editing means for editing data with respect to a designated layer in accordance with a layer designation and an editing instruction inputted by the operator and storing edited data into the memory means;

wherein the editing means has a function to set a password with respect to a specific layer based on demand of the operator and, when a layer in which the password is set is designated, to edit contents of the designated layer provided that the password is inputted.

(3) The third feature of the invention resides in a presentation apparatus for two-dimensional picture information, comprising:

display means for displaying a predetermined picture in a two-dimensional display area;

memory means for preserving contents to be displayed in the display area as data in a state divided into plural layers;

display control means for reading out data with respect to a designated layer from the memory means in accordance with a layer designation inputted by an operator, preparing a picture to be displayed on the basis of the data which has been read out and delivering the prepared picture to the display means to display it; and editing means for editing data with respect to a designated layer in accordance with a layer designation and an editing instruction inputted by the operator and storing edited data into the memory means;

wherein the display control means has a function to set a display password with respect to a specific layer based on demand of the operator and, when a layer in which the display password is set is designated, to display contents of the designated layer in the display area provided that the display password is inputted; and wherein the editing means has a function to set an editing password with respect to a specific layer based on demand of the operator and, when a layer in which the editing password is set is designated, to edit contents of the designated layer provided that the editing password is inputted.

(4) The fourth feature of the invention resides in a presentation apparatus for two-dimensional picture information in accordance with the first or the third feature:

wherein data of a specific layer is preserved within the memory means in an enciphered state, whereby in the case where collation of the password is succeeded, the data is decoded so that contents of the specific layer are displayed in a state where they can be recognized, while in the case where collation of the password is failed, the data is not decoded so that contents of the specific layer are displayed in a state where they cannot be recognized.

(5) The fifth feature of the invention resides in a presentation apparatus for two-dimensional picture information in accordance with the first to the fourth features, further comprising:

file synthesis means having a function to combine a first file and a second file into a third file;

wherein the first file consists of a first group of data having at least one layer and a second group of data having at least one layer, and the second file consists of a third group of data having at least one layer and a fourth group of data having at least one layer, the first group of data and the third group of data being same; and wherein the file synthesis means produces the third file by gathering the first, second and fourth group of data.

(6) The sixth feature of the invention resides in a computer readable recording medium on which there is recorded a program for allowing a computer to function as the memory means and the display control means mentioned in the first to the fifth features.

(7) The seventh feature of the invention resides in a computer readable recording medium on which there is recorded a program for allowing a computer to function as the memory means, the display control means and the editing means mentioned in the first to the fifth features.

DESCRIPTION OF THE PREFERRED EMBODIMENT

This invention will now be described in accordance with the embodiment shown below.

§1 Apparatus for Presenting Information Relating to Map

Figure 1:
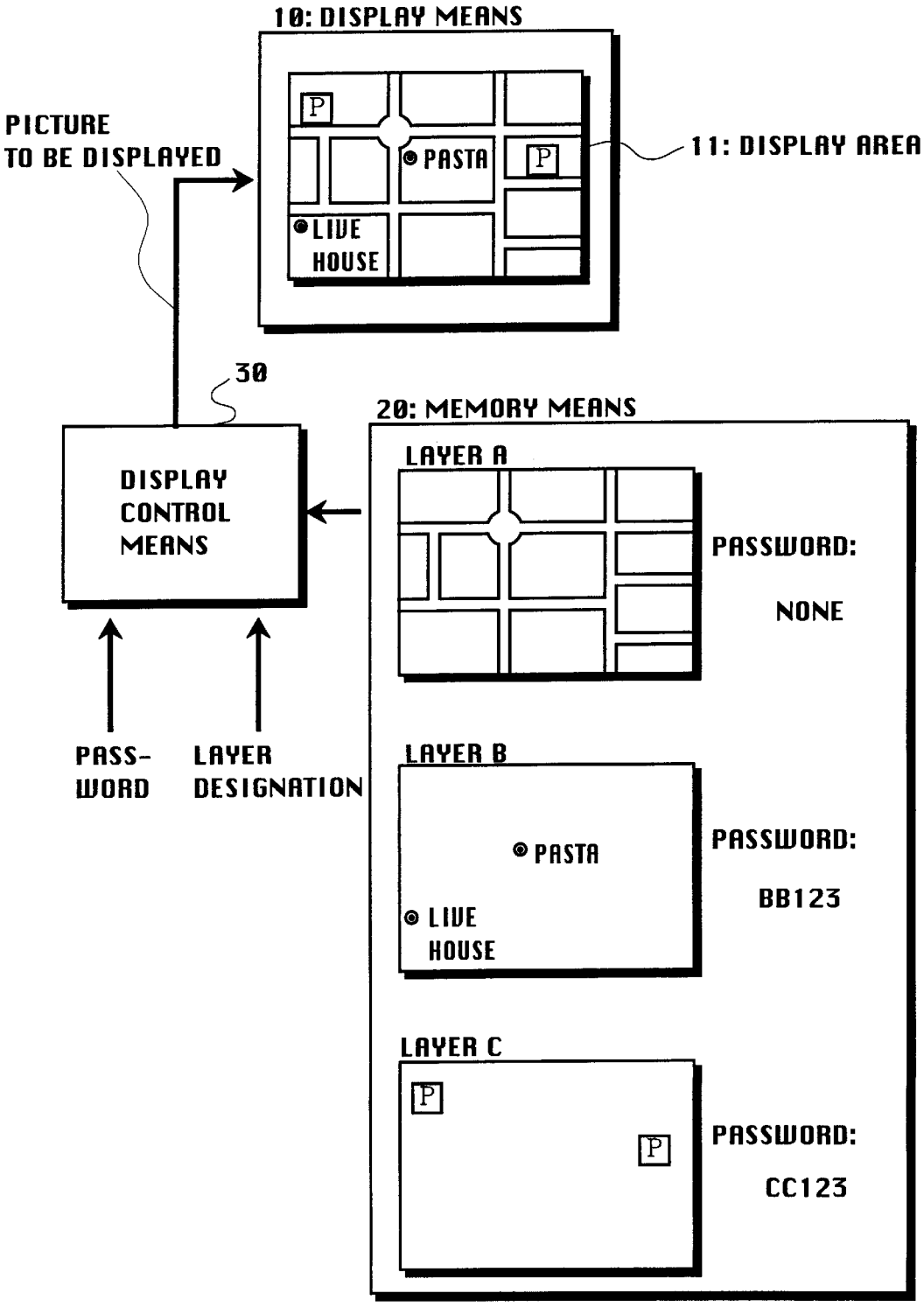
FIG. 1 is a block diagram showing fundamental configuration of a presentation apparatus for two-dimensional picture information according to an embodiment of this invention.

The preferred embodiment to which the present invention is applied to an apparatus for presenting map onto two-dimensional display will be first described. FIG. 1 is a block diagram showing a fundamental configuration of the apparatus according to this embodiment. As shown, this apparatus is composed of display means 10, memory means 20 and display control means 30. The display means 10 has a function to display a predetermined picture in a two-dimensional display area 11, and can be constituted by widely used display device for computer in more practical sense. The memory means 20 has a function to preserve contents to be displayed on the display area 11 in the state divided into plural layers which have a common two-dimensional coordinate. The memory means 20 can be constituted by a memory device or an external memory unit for computer in more practical sense. In this example, there is shown the state where information relating to map is preserved into three layers A, B and C. In addition, the display control means 30 has a function to read out data of a designated layer or designated layers from the memory means 20 in accordance with a layer designation command given from the external. The display control means 30 also has a function to prepare a picture to be displayed on the basis of the data which has been read out and to present the prepared picture on the display area 11 of the display means 10. In practical, the display control means 30 can be realized by program installed into the computer.

In the example shown, fundamental information of map is included in the layer A preserved within the memory means 20. Information of restaurant within this map is included in the layer B, and information of the parking area within the map is included in the layer C. Information of these three layers A, B and C are synthesized and displayed on the display area 11 of the display means 10. When a user gives a layer designation command which instructs to display all the three layers A, B and C, to the display control means 30, the display control means 30 reads out all the data included in the three layers A, B and C from the memory means 20 and synthesizes those data (superimpose them on a common two-dimensional coordinate plane) so that a display as shown in FIG. 1 is obtained in the display area 11.

The characterized feature of this apparatus is that a password can be set with respect to a specific layer as occasion demands. In the example shown, a password is not set by any means to the layer A, a password of "BB123" is set for the layer B, and a password of "CC123" is set for the layer C. While these passwords are preserved within the memory means 20 along with data of the respective layers, it is preferable that they are preserved in such a way that they cannot be recognized by ordinary read-out method. In the case where a layer in which a password is set is designated, the display control means 30 displays the contents of this designated layer on the display area 11, provided that the proper password has been inputted. For example, when a user gives a layer designation command to display all of the three layers A, B and C, the display control means 30 makes a request for a password for displaying the layer B and a password for displaying the layer C. If the user inputs correct passwords, i.e., "BB123" and "CC123" with respect to this request, a display as shown in FIG. 1 is obtained in the display area 11. However, if a correct password has not been inputted with respect to a particular layer, the contents of this particular layer are not displayed.

In such a system to make a request for a password for the purpose of displaying a specific layer, it is possible to maintain security. Let consider the case where a CD-ROM in a form of memory means 20 as shown in FIG. 1 is put on sale as software map. Assuming that an initial price of this CD-ROM is set to an utilization cost of the layer A (utilization cost of only fundamental map information). In this case, a user who has purchased this CD-ROM can display the contents of the layer A on the display area 11 by using the display control means 30 (a computer provided with a CD-ROM drive unit in this case). However, since the user does not know a password with respect to the layer B or C, the contents of these layers cannot be displayed. In view of the above, when the user intends to display restaurant information on the map, it is sufficient to pay utilization cost of the layer B (utilization cost of restaurant information) to thereby obtain the password "BB123". By inputting this password with respect to the display control means 30, restaurant information can be obtained on the display area 11. Moreover, in the case where the user intends to further display information of the parking area on the map, utilization cost of the layer C (utilization cost of parking area information) may be paid to thereby obtain the password "CC123". Of course, payment of the cost may be done through an on-line system and a password can be delivered through the on-line system. In addition, information of further layers (e.g., information indicating location of play facilities) may be obtained through the internet.

Though a password is used for displaying a specific layer in the above-mentioned example, a password can be used for allowing edit in a specific layer. In the apparatus shown in FIG. 2, editing means 40 is further added to the apparatus shown in FIG. 1. The editing means 40 has a function to read out data with respect to the designated layer from the memory means 20 in accordance with a layer designation command inputted from the external, to edit the read out data in accordance with an editing instruction inputted from the external, and to write back the edited data into the memory means 20. In the example shown in FIG. 2, fundamental map information is included in the layer A preserved within the memory means 20, individual information of the user B (location of home of the user B in the example shown) is included in the layer B, and individual information of the user C (location of shop and home of the user C in the example shown) is included in the layer C. Data of the layer B or C is data that the respective users themselves have written by giving a predetermined layer designation command and an editing instruction to the editing means 40.

Figure 2:
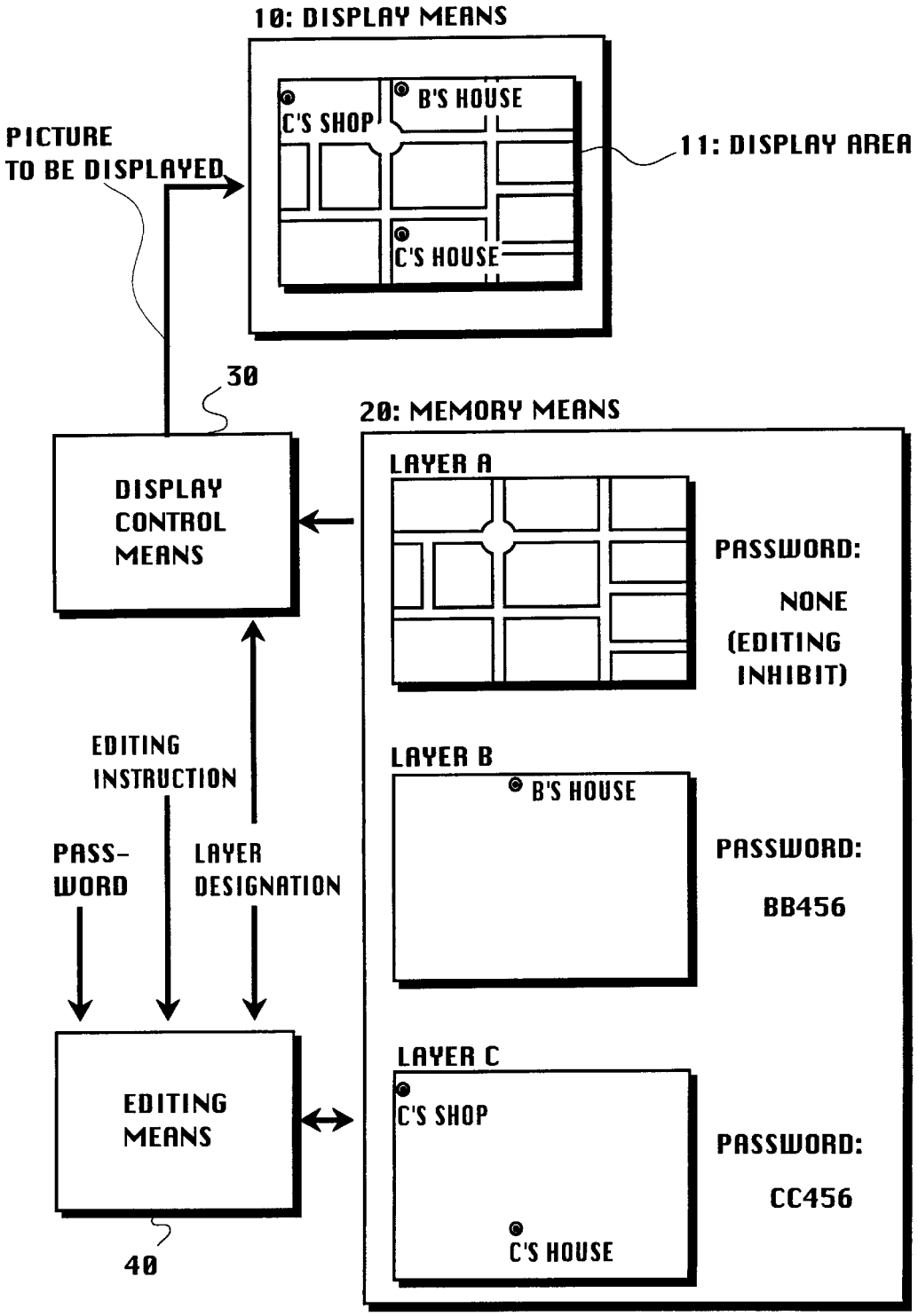
FIG. 2 is a block diagram showing an example of the configuration in which editing means 40 is further added to the presentation apparatus shown in FIG. 1.

In the case of the apparatus of FIG. 2, a password is not required by any means when individual layers are displayed. However, in the case when editing with respect to a particular layer is carried out, a predetermined password is required. For the layer A, a password is not set, but editing is inhibited by any means with respect to the contents of this layer A (such an approach may be employed by setting any password for the layer A and inhibiting every user to know this password). On the other hand, the password of "BB456" is set for the layer B and the password of "CC456" is set for the layer C. These passwords are set for allowing users B and C to provide access to their own layers. When a layer for which a password has been set is designated to be edited, the editing means 40 executes editing with respect to the contents of this designated layer, provided that the proper password is inputted. Accordingly, if the user B tries to register location of his home, it is necessary to designate the layer B to carry out this registration work by inputting the password "BB456" into the editing means 40. Similarly, in the case where the user C tries to register location of his shop or his home, it is necessary to designate the layer C to carry out this registration work by inputting the password "CC456" into the editing means 40.

In accordance with such a system to require a password for editing a specific layer, the security relating to editing can be taken into consideration. Namely, even in the case where plural users utilize the same system as shown in FIG. 2, as a layer including individual information of a specific user can be edited only by this user, there is no possibility that the individual information is altered by the other user.

Of course, in the apparatus shown in FIG. 2, a password for displaying a specific layer can be also set. An example where a display password for displaying a specific layer and an editing password for editing a specific layer are set in this way is shown in the block diagram of FIG. 3. Though the contents themselves of layers A, B and C preserved in the memory means 20 are the same as that shown in FIG. 2, both the editing password "BB456" and the display password "BB789" are set with respect to the layer B, and both the editing password "CC456" and the display password "CC789" are set with respect to the layer C. Accordingly, when the user tries to edit the layer B or C, it is necessary to input the editing password "BB456" or "CC456" to the editing means 40 and when the user tries to display the contents of the layer B or C, it is necessary to input the display password "BB789" or "CC789" to the display control means 30.

As described above, when both the display password and the editing password are set with respect to a specific layer, only the user is permitted to display or to edit the contents of this specific layer which includes his/her individual information. Thus, higher level security can be ensured.

Figure 3:
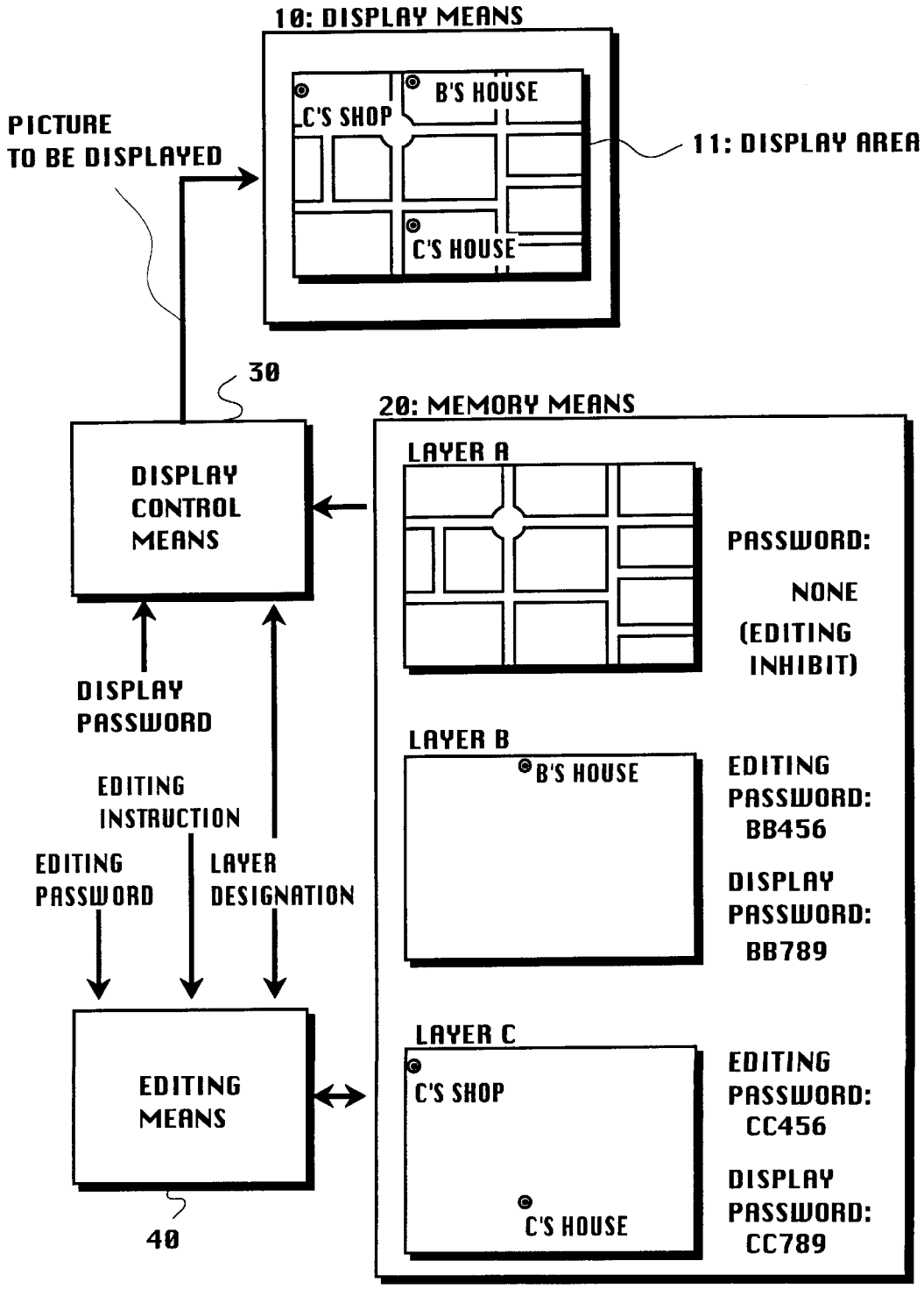
FIG. 3 is a block diagram showing an example in which both display password and editing password are set in the presentation apparatus shown in FIG. 2.
Figure 4:
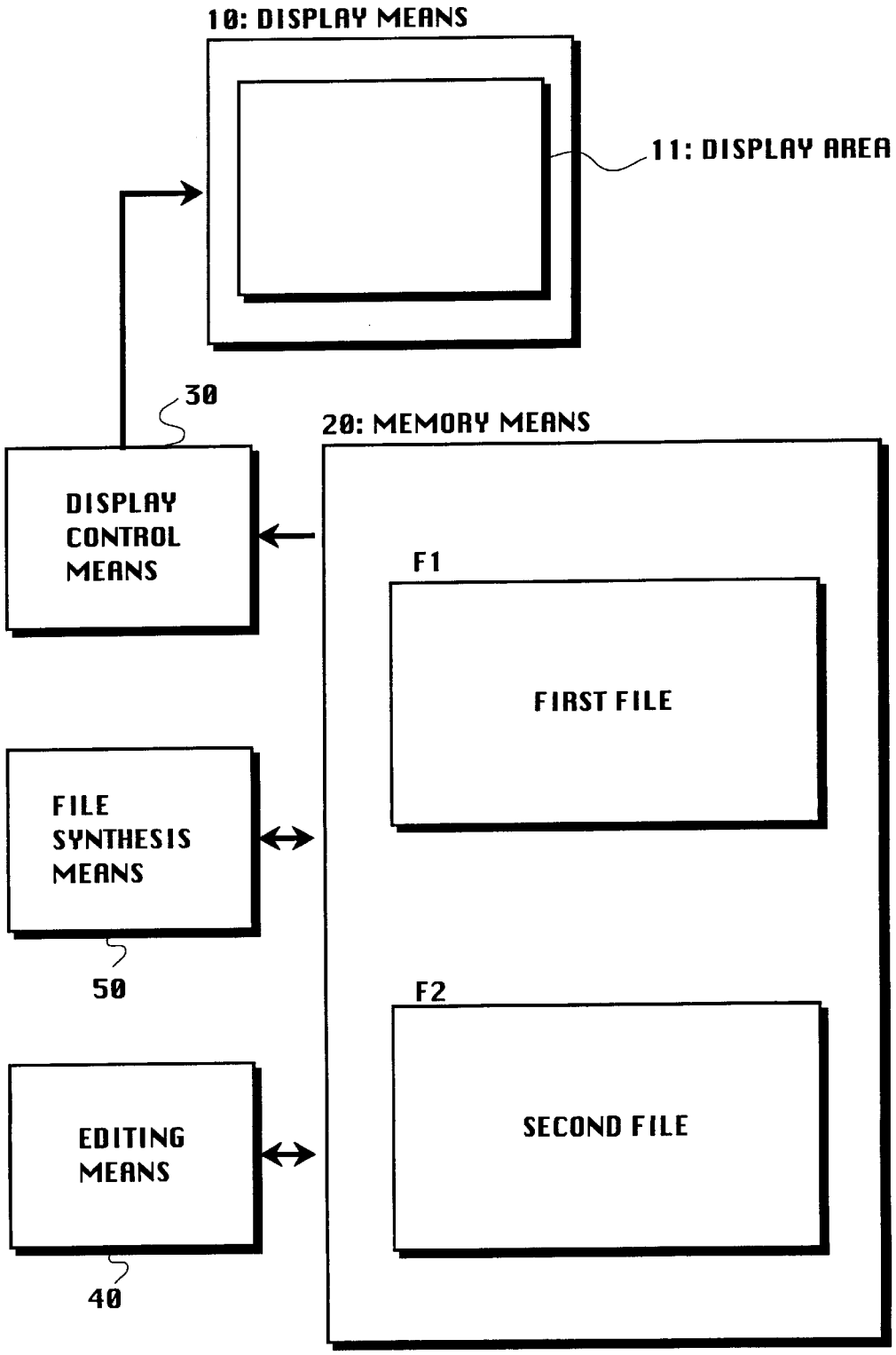
FIG. 4 is a block diagram showing an example of the configuration in which file synthesis means 50 is further added to the presentation apparatus shown in FIG. 2.

The presentation apparatus shown in FIG. 4 is an apparatus in which file synthesis means 50 is further added to the apparatus shown in FIG. 2 or 3. The file synthesis means 50 has a function to synthesize plural files preserved within the memory means 20. The function of the file synthesis means 50 will now be described in a practical example in which a first file F1 and a second file F2 within the memory means 20 are synthesized.

Figure 5:
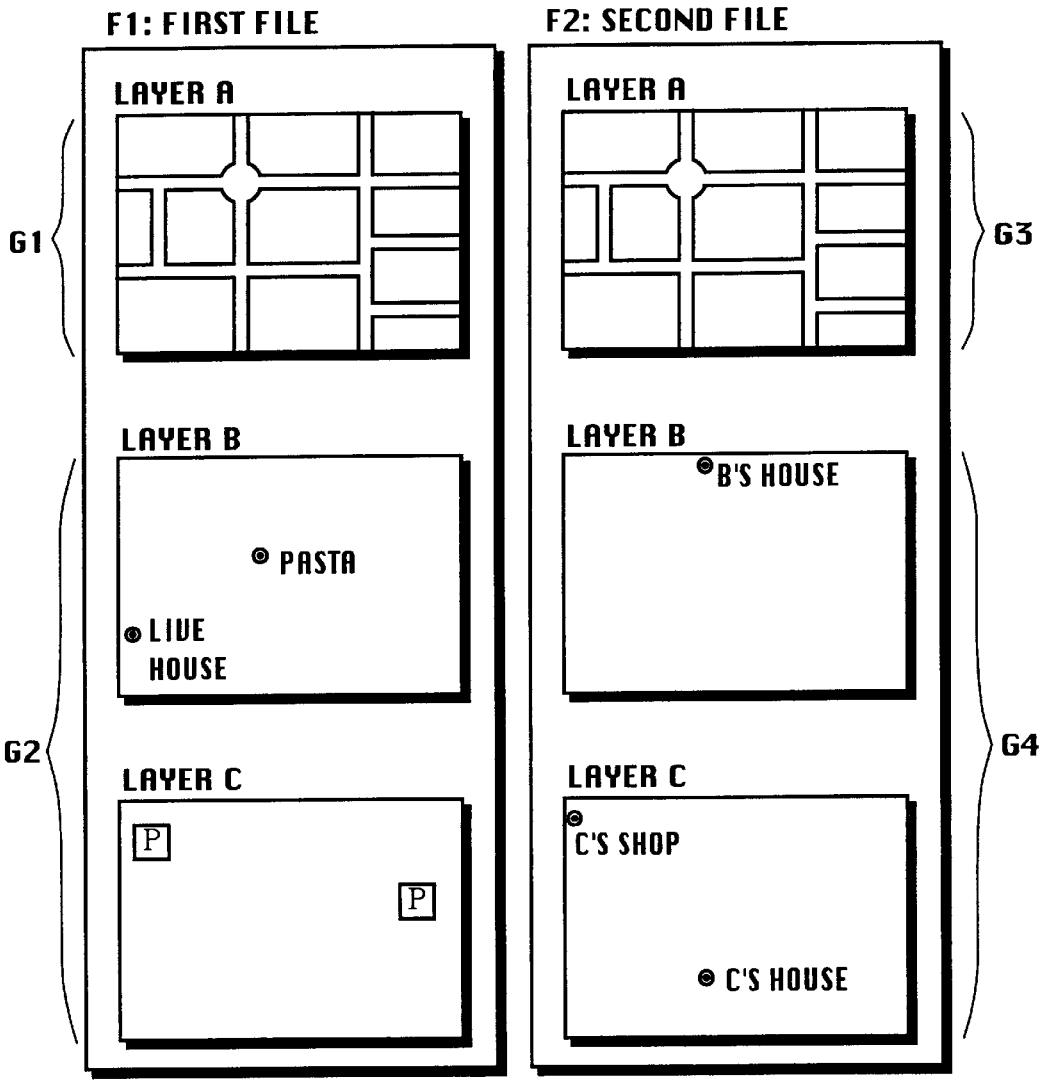
FIG. 5 is a view showing layer configuration of the two files F1, F2 preserved within memory means 20 of the presentation apparatus shown in FIG. 4.

Let now consider that the two files F1, F2 preserved within the memory means 20 have layer configuration as shown in FIG. 5. The first file F1 is a file composed of three layers A, B and C preserved within the memory means 20 of FIG. 1 and the second file F2 is a file composed of also three layers A, B and C preserved within the memory means 20 of FIG. 2. All these files consist of information relating to the map, wherein the first file F1 is a file including location information of restaurants and parking areas and the second file F2 is a file including individual information of the users B and C. In general, picture information processed by computer is handled as a file, and the display control means 30 and the editing means 40 have a function to display or edit the contents of the file. Accordingly, as shown in FIG. 5, information in the first file F1 and information in the second file F2 within the memory means 20 are handled as individual information and they could not be handled in unified manner. The file synthesis means 50 has a function to synthesize such two files F1 and F2 to merge them into a new file F3. The fundamental principle of the file synthesis operation that the file synthesis means 50 carries out is as follows.

Initially, layers having the common contents are recognized among these layers constituting the two files F1 and F2 In case of the example shown in FIG. 5, the layer A within the first file F1 and the layer A within the second file F2 are layers having the common contents of fundamental map information (hereinafter these layers are referred to as a common layer). On the contrary, the layers B and C within the first file F1 and the layers B and C within the second file F2 are layers having individual information (hereinafter these layers are referred to as an individual layer). Now, for convenience of explanation, the classification is assumed to be made such that the common layer A of the first file F1 belongs to the first group G1, the individual layers B and C of the first file F1 belong to the second group G2, the common layer A of the second file F2 belongs to the third group G3 and the individual layers B and C of the second file F2 belong to the fourth group G4. After such a classification is made, the layers belonging to the first group G1, the layers belonging to the second group G2 and the layers belonging to the fourth group G4 are gathered to constitute the third file F3. This third file F3 is a file obtained by synthesizing the first file F1 and the second file F2.

Figure 6:
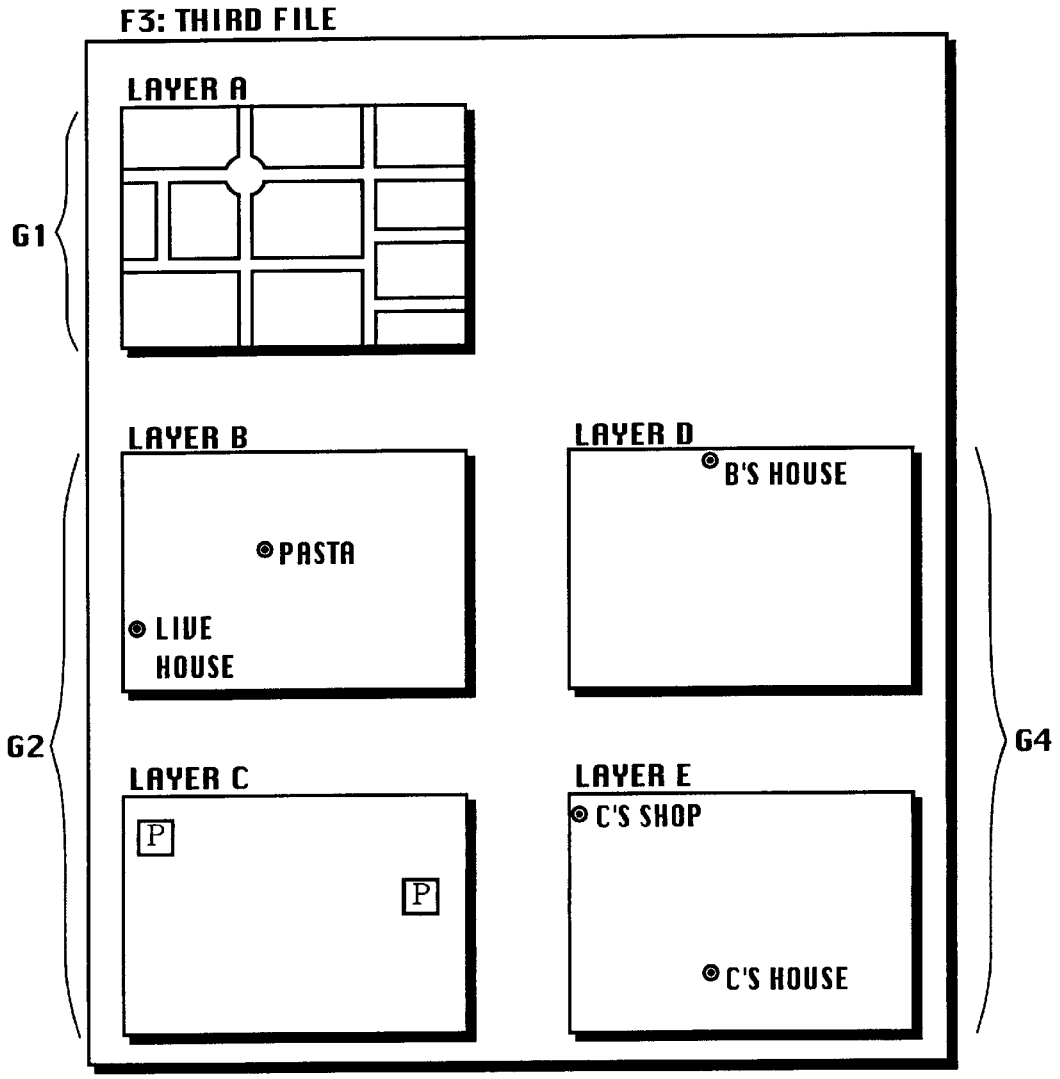
FIG. 6 is a view showing layer configuration of the file F3 obtained by synthesizing the two files F1, F2 shown in FIG. 5.

FIG. 6 is a block diagram showing the layer configuration of the third file F3 thus obtained. It is seen that only a layer belonging to the third group G3 shown in FIG. 5 is deleted. Since the layers B and C belonging to the second group G2 and the layers B and C belonging to the fourth group G4 have the same names in the example shown in FIG. 5, the names of the layers belonging to the fourth group G4 are changed to D and E in the third file F3 shown in FIG. 6. It is to be noted that passwords set for the respective layers before this synthesis operation are caused to be maintained as they are.

When the two files F1 and F2 are merged into the third file F3 as mentioned above, the display control means 30 and the editing means 40 can handle the five layers A to E included in the third file F3 in unified manner. For example, all the five layers A to E can be displayed in the display area 11 in the state where they overlap with each other, provided that the proper passwords are inputted. In addition, since only one of the common layers is left and the other layer or layers are deleted, irrationality such that the same layers are caused to overlap with each other within the same file can be avoided. Of course, the third file F3 prepared by this synthesis operation is further synthesized with another fourth file F4, thereby making it possible to prepare a fifth file F5.

§2 Apparatus for Presenting Correction Information in DTP

Subsequently, another embodiment will now be described, in which the present invention is applied to the apparatus for presenting correction information onto the two-dimensional display in DTP. Since the block configuration of this apparatus is the same as the apparatus for presenting map information described in §1 (e.g., the apparatus shown in FIG. 3), only the contents displayed on the display area 11 and the layer configuration within the memory means 20 will be explained.

Figure 7:
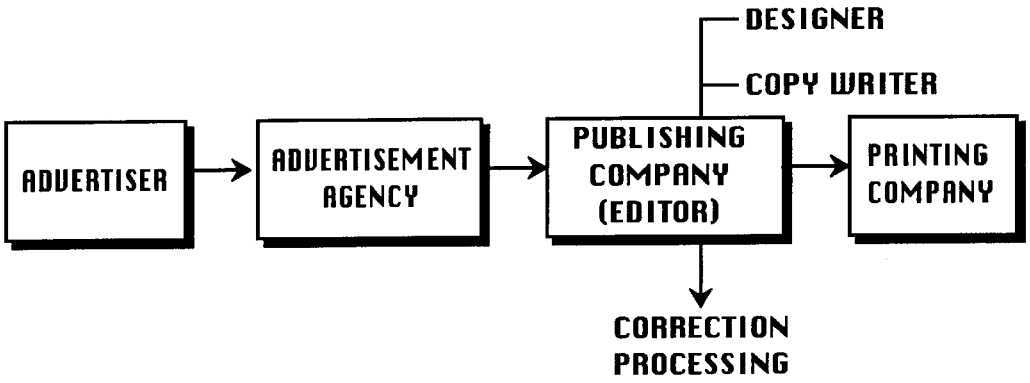
FIG. 7 is a block diagram showing an example of flow of work in the case where advertiser publishes advertisement of mail order on magazine, etc.

FIG. 7 is a block diagram showing one example of flow of work in the case where an advertiser publishes advertisement of mail order on magazine, etc. First of all, the advertiser makes an order of advertisement to an advertisement agency. The advertisement agency gives an instruction to a publishing company so as to prepare contents of advertisement in comply with the need of the advertiser. At the publishing company, an editor in charge prepares advertisement pages in accordance with the advertiser's demand with being helped by an external designer or a copy writer. Ordinarily, at the publishing company, the editor in charge proceeds with work by using dedicated software, and work result (picture to be printed) is stored in a form of a digital file with format of this software. When this file is sent to the printing company, actual printing process is carried out. Usually, a correcting procedure is carried out before the actual printing process. Although the correcting procedure can be carried out by using DTP dedicated software, in recent years a general-purpose document processing software is widely used for this correcting procedure. In this case, picture data to be printed is converted into a file of general-purpose format and the correcting procedure is carried out for this converted file using the general-purpose document processing software. In this embodiment, a file prepared by the DTP dedicated software at the publishing company is converted into a PDF file (Portable Document Format: a general-purpose format which the U.S. Adobe systems Inc. has announced) and the correcting procedure is carried out by inputting correcting instructions to this PDF file.

Figure 8A:
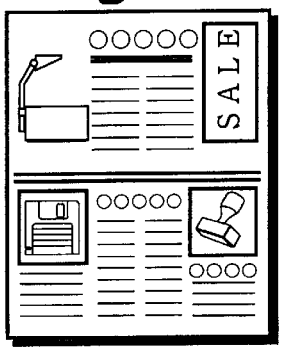
FIGS. 8A to 8D are views showing progressive states of correcting work on display screen with respect to picture to be printed which is prepared by publishing company.

For convenience of explanation, a picture to be printed as shown in FIG. 8A is assumed to be prepared at the publishing company. Various picture information such as photo pictures, illustration pictures and image of character strings, etc. are included in a picture to be printed. At the publishing company, the picture to be printed is converted into a PDF file and this PDF file is distributed to respective correctors. While the PDF file may be distributed through a physical medium such as floppy disc, etc., it is common at present to distribute it on the on-line basis by using communication line. The correcting work is ordinarily carried out not only by an editor in charge in the publishing company but also by a designer, a copy writer, an advertiser and an advertisement agency who participate in this publishing work. In this example, let consider the case where the correcting work is carried out by three persons of an editor, a designer and a copy writer with respect to a picture to be printed shown in FIG. 8A for convenience of explanation.

Figure 8B:
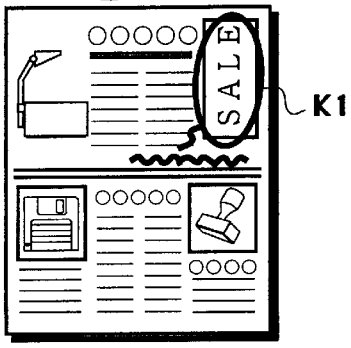
Figure 8C:
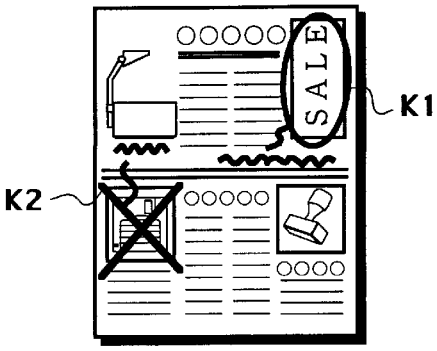
Figure 8D:
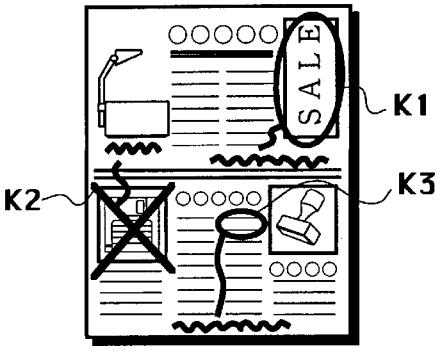

The correcting work on the display screen is usually similar to the work on the actual paper. That is, figures, symbols or comments are written onto a picture on the screen with relatively conspicuous color. It is now assumed that, with respect to the picture to be printed shown in FIG. 8A, a correcting indication K1 as shown in FIG. 8B is written by the editor, a correcting indication K2 as shown in FIG. 8C is subsequently written by the designer and a correcting indication K3 as shown in FIG. 8D is finally written by the copy writer. The respective correcting indications K1, K2 and K3 are messages for instructing change of font or size, or color modification with respect to a portion of a specific character or a picture. At the next stage in the publishing company, necessary modification is made to the picture to be printed on the basis of these messages thereafter to make an order of printing to the printing company.

When the apparatus according to this invention is used, it is possible to preserve these correcting indications on individual layers for respective correctors. The file F shown in FIG. 9 consists of four layers L0 to L3. In this example, the layer L0 includes a picture itself to be printed and this picture is a subject for correction work. On the other hand, the layers L1, L2 and L3 are layers for preserving correcting indications of the editor, the designer and the copy writer, respectively.

When the apparatus according to this invention shown in FIG. 3 is used, it is possible to set an editing password and a display password as occasion demands for every respective layer. In the case of the example shown in FIG. 9, though a display password is not set for the layer L0 so that everybody can freely display the layer L0, an editing password is set for the layer L0 by the editor of the publishing company so as to inhibit editing by somebody except for the editor.

With respect to the layers L1 to L3, no display password is set so that everybody can freely display the layers L1 to L3. However, respective editing passwords are set by the individual correctors to permit editing only by the authorized correctors. That is, specific editing passwords are set for the layers L1, L2 and L3 by the editor, the designer and the copy writer, respectively, so that editing work for the layers L1, L2 and L3 is only permitted by the editor, the designer and the copy writer, respectively. If there is employed an approach to set such a security that respective correctors can edit only his/her own layer, responsibility for correcting instructions becomes clear, thus making it possible to prevent occurrence of useless trouble.

Figure 10:
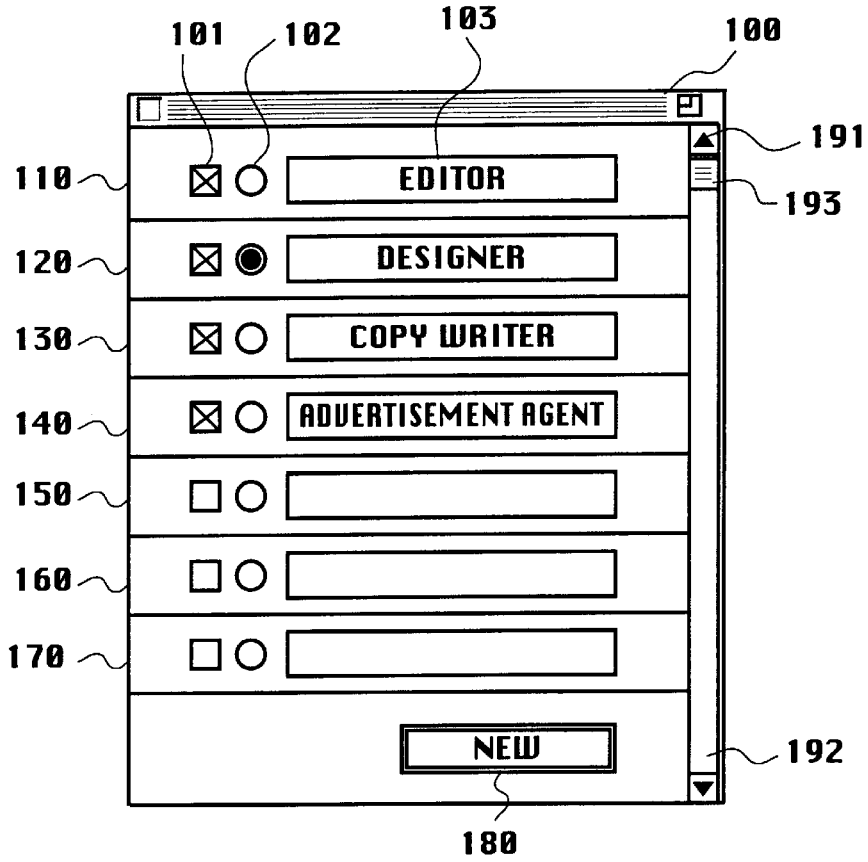
FIG. 10 is a view showing layer management window 100 for carrying out management of layer for correction.

It is to be noted that, in the apparatus according to this embodiment, a window 100 shown in FIG. 10 is displayed on the display screen so that management of correction layers can easily be made. On the layer management window 100, layer display columns 110 to 170 are arranged, and a NEW button 180 for preparing "new correction layer" is provided. Moreover, in the vicinity of the right side, there are scrolling buttons 191, 192 and a scrolling bar 193 for carrying out scrolling operation of the respective layer display columns 110 to 170 in upper and lower directions. In the respective layer display columns 110 to 170, check boxes 101, radio buttons 102 and title windows 103 are respectively provided.

Figure 9:
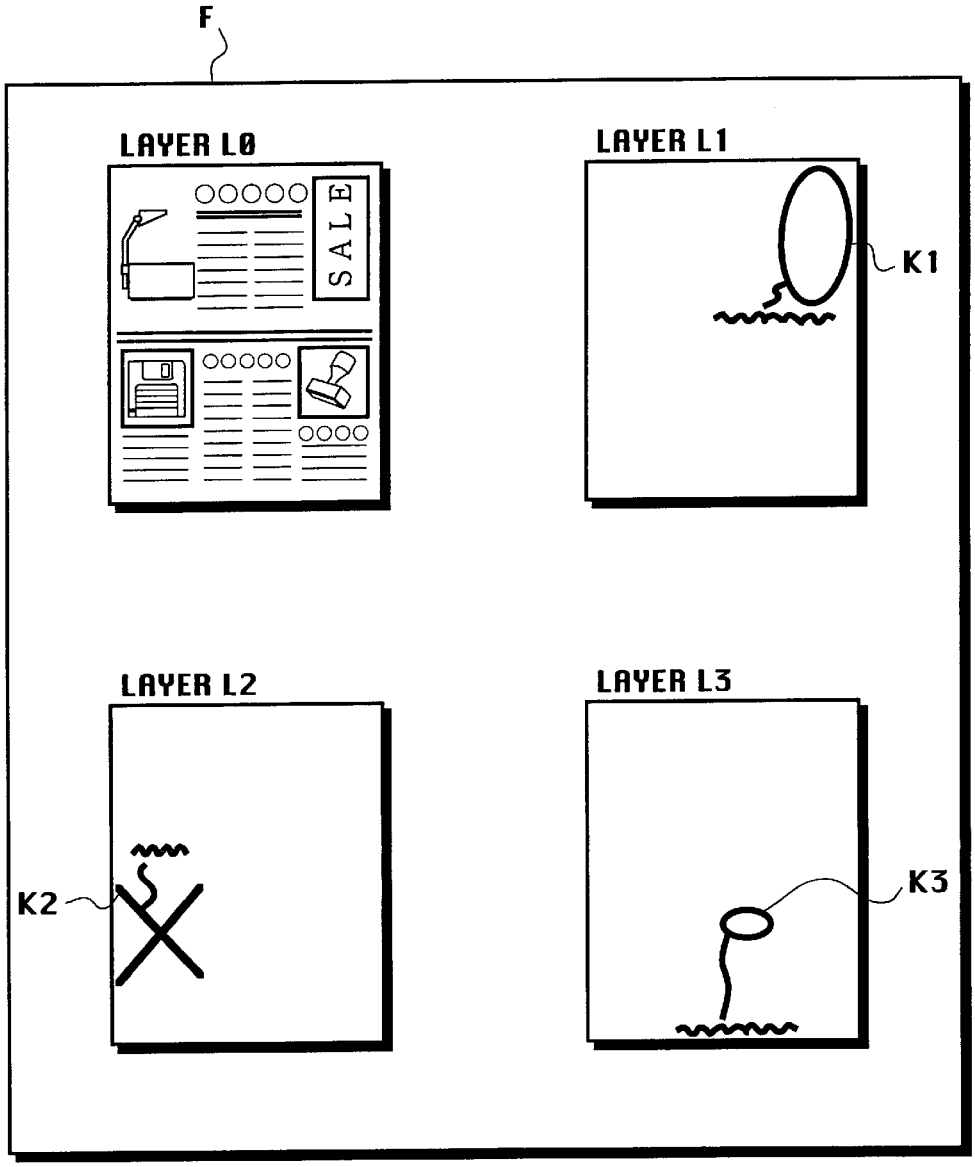
FIG. 9 is a view showing layer prepared by the correcting work shown in FIGS. 8A to 8D.

One layer display column corresponds to one correction layer, and, e.g., the layer display columns 110, 120, 130 respectively correspond to the layers L1, L2, L3 in the file F in FIG. 9. Layer names attached to the corresponding layers (corrector name in the case of this example) are displayed on the title windows 103.

The check box 101 serves to designate whether or not the corresponding layer should be displayed. Every time the check box 101 is clicked by a pointing device such as mouse, etc., a check mark X is attached or is not attached (alternately inverted). On the display screen, only the layers having check mark X are displayed. In the example shown, four layers corresponding to the layer display columns 110 to 140 are displayed. It is to be noted that since a display password is not set by any means in this embodiment, inverting operation of the check box 101 can be freely carried out without inputting any password.

Figure 11:
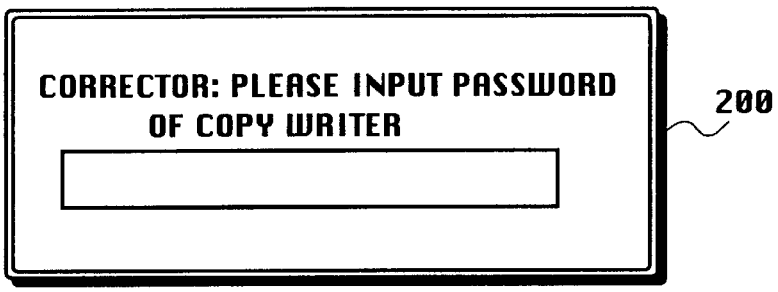
FIG. 11 is a view showing dialog box 200 which is displayed when a specific layer is designated in the layer management window 100 shown in FIG. 10.

On the other hand, the radio button 102 serves to designate whether or not editing is carried out with respect to the corresponding layer. Every time the radio button 102 is clicked by a pointing device such as mouse, etc., a black circle is attached or is not attached (alternately inverted). It is to be noted that addition of black circle is exclusive. In other word, the black circle can be attached to only one of the layer display columns. For example, when the radio button 102 within the layer display column 130 is clicked in the state as shown in FIG. 10, the black circle of the radio button 102 within the layer display column 120 is released. Eventually, the editing work is carried out for only a chosen correction layer at all times. In addition, when the radio button 102 is newly clicked to chose a specific layer so that it is to be edited, a dialog box 200 as shown in FIG. 11 is displayed on the screen. This dialog box 200 demands input of the editing password with respect to the corresponding layer. FIG. 11 shows the example where the radio button 102 within the layer display column 130 is clicked to chose the correction layer for copy writer to be edited. In this case, if the correct password is inputted, choosing operation of the radio button 102 is handled as effective. On the contrary, in the case where the inputted password is not correct, this choosing operation is nullified.

Figure 12:
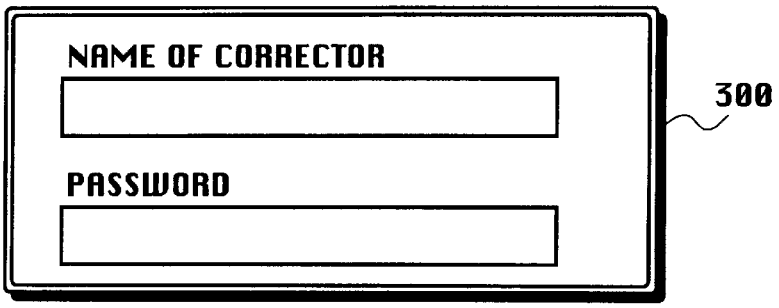
FIG. 12 is a view showing dialog box 300 which is displayed when the NEW button 180 of the layer management window 100 shown in FIG. 10 is pushed down in order to prepare a new correction layer.

When the NEW button 180 is clicked in order to add a new correction layer, a dialog box 300 as shown in FIG. 12 is displayed. The user may input any character strings for NAME OF CORRECTOR (name of layer) and PASS WORD (editing password) in the respective columns. For example, if a correction layer for the advertiser is newly supplemented, the user inputs "advertiser" at the column of NAME OF CORRECTOR and an arbitrary password at the column of PASS WORD. Thus, the new name "advertiser" is inserted in the blank title window 103 of the layer display column 150 in FIG. 10 and a new layer is supplemented.

While the embodiment in which file synthesis means 50 is further provided has been described in §1 as shown in FIG. 4, this file synthesis means 50 is extremely useful also in the above-described apparatus for correction work. For example, in the above-described procedure, there has been carried out a sequential correction work for the picture shown in FIG. 8A. That is, the editor writes the correcting indication K1 at the first stage (FIG. 8B), then the designer writes the correcting indication K2 at the second stage (FIG. 8C) and finally the copy writer writes the correcting indication K3 at the third stage (FIG. 8D). When the sequential correction work by the plural correctors is carried out in this way, all the correcting indications are preserved in the same file F as shown in FIG. 9.

However, in practice, a parallel correction work is apt to be carried out by the plural correctors. Let consider, e.g., the case where the editor and the copy writer are carrying out their correction work at an office A, but the designer is carrying out his/her correction work at another office B. In this case, it is possible to proceed with the correction works in parallel at the two offices by the following way. First of all, a pre-correction file including only the layer L0 (picture to be printed) is duplicated to prepare a first file F1 and a second file F2 (both the files consist of only the layer L0). Then the correction work using the first file F1 is carried out at the office A and the correction work using the second file F2 is carried out at the office B in parallel. Assuming that, at the office A, a correction layer L1 for the editor is newly added in the first file F1 and the editor writes the correcting indication K1 on this layer L1 and, subsequently, a correction layer L3 for the copy writer is newly added in this first file F1 and the copy writer writes the correcting indication K3 on this layer L3. In the upper part of FIG. 13, the layer configuration of the first file F1 after the above-described correction work has been done is shown. On the other hand, at the office B, a correction layer L2 for the designer is newly added in the second file F2 and the designer writes the correcting indication K2 on this layer L2. In the lower part of FIG. 13, the layer configuration of the second file F2 after the above-described correction work has been done is shown.

Figure 13:
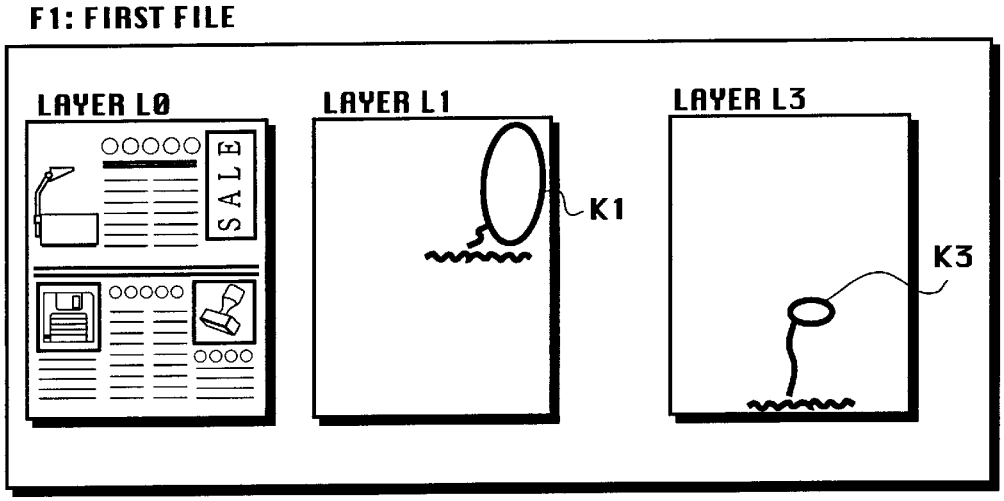
FIG. 13 is a view showing layer configuration of the two files F1, F2 obtained in the publishing company at the stage when correcting work, which is carried out in parallel, has been completed.
Figure 13:
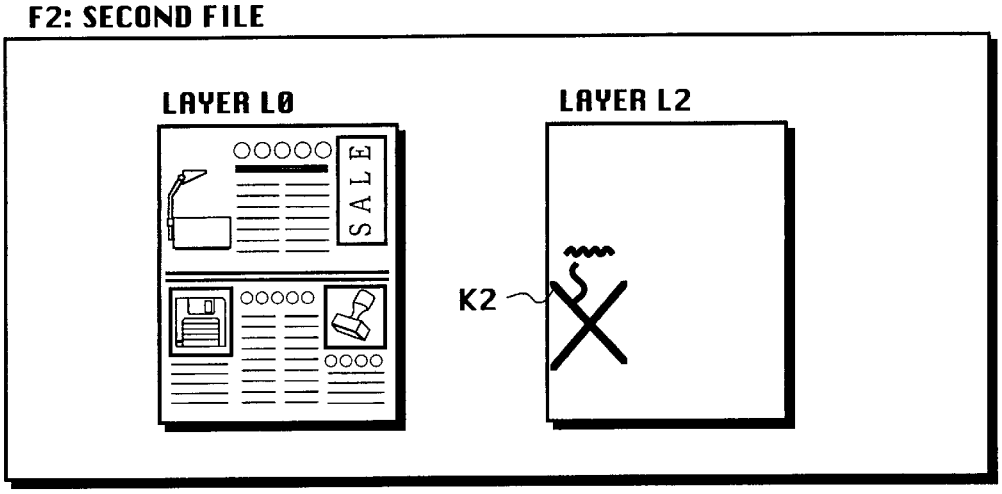

Eventually, at the stage where the above-described correction work is completed, two files F1 and F2 as shown in FIG. 13 should be gathered at the publishing company. For this purpose, the file synthesis means 50 can be utilized. When file synthesis processing by the file synthesis means 50 is carried out, it is possible to prepare a single file F as shown in FIG. 9 on the basis of the files F1 and F2. Namely, among the five layers constituting the two files F1 and F2 as shown in FIG. 13, common layers L0 (of the first file F1 and the second file F2) having common contents are recognized. Then either one of the common layers is left and the other is deleted. Of course, it is preferable that any passwords set at the respective layers before the synthesis processing are maintained as they are after the synthesis processing.

Figure 14:
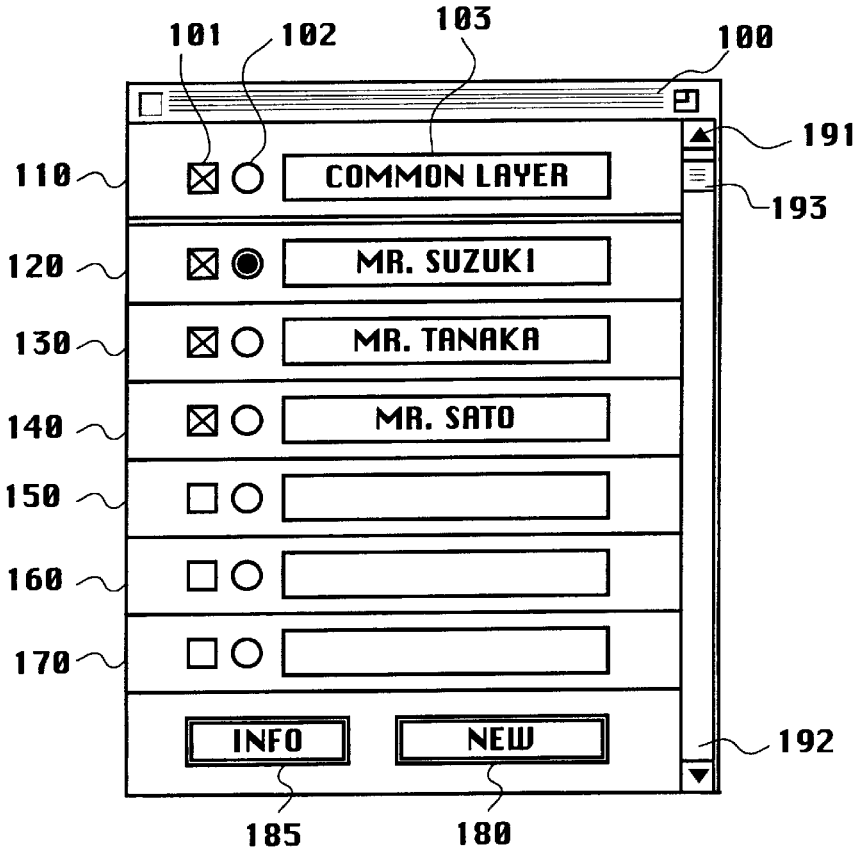
FIG. 14 is a view showing another embodiment of layer management window 100 for managing layer for correction.

FIG. 14 shows a modified example of the layer management window 100 shown in FIG. 10. In the example shown in FIG. 14, the layer display column 110 of the uppermost row indicates a default layer named "common layer", this layer name being displayed in advance at the title window 103. This "common layer" is a layer commonly utilized by all the correctors and there is no security. Therefore, a password is not required by any means to display or edit the contents of this layer. It is very convenient to write a correction information on this "common layer", as far as the information does not require any security. When sufficient security should be ensured, individual layers indicated by the layer display columns 120, 130, 140 . . . (in this example, user names of Mr. Suzuki, Mr. Tanaka, Mr. Sato . . . are set as layer names) can be used by inputting proper passwords as mentioned in the above-described example.

Figure 15:
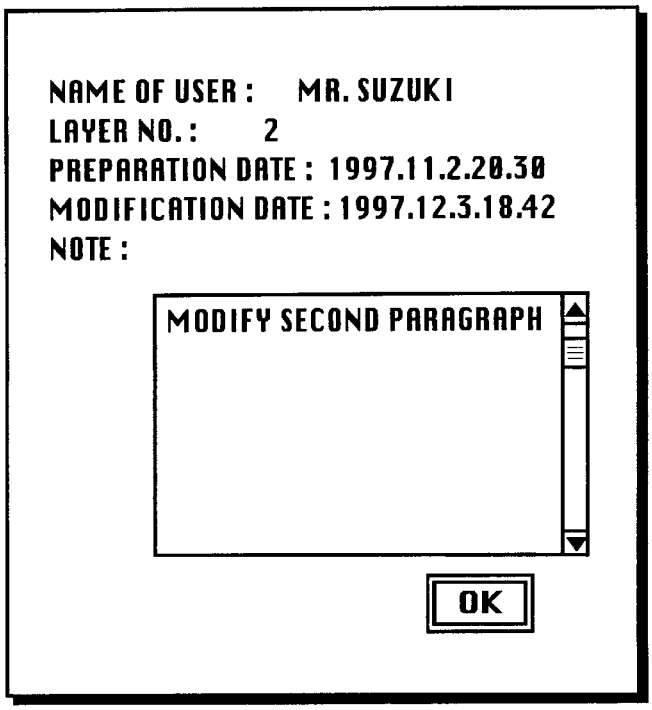
FIG. 15 is a view showing an example of window for displaying layer information.

Another feature of the example shown in FIG. 14 resides in that the layer information button 185 is provided. This layer information button 185 is a button for displaying various information in regard to a chosen specific layer. When this layer information button 185 is clicked in the state where the layer titled Mr. Suzuki is chosen as shown in FIG. 14, a layer information window as shown in FIG. 15 is displayed. In the example shown in FIG. 15, information of user name, layer No., preparation date, modification date and note are displayed in the window with respect to the chosen layer of Mr. Suzuki. The user can display this layer information window as occasion demands to confirm various information and thereafter he/she can close the window by clicking "OK" button at the right lower portion. It is to be noted that note can be directly inputted on the layer information window.

§3 Other Embodiments

While this invention has been described on the basis of various embodiments, this invention is not limited to these embodiments, but can be carried out in various modes in addition to the above-described embodiments. Particularly, two-dimensional picture information to be presented is not limited to information relating to map or information relating to correcting indication. This invention can be utilized for presenting various information using plural layers. For example, this invention can be used for presenting questions on the display screen in examination. That is, the contents with respect to the examination are preserved on a question layer, an answer sheet layer, and a correct answer layer, etc. In this case, a student can display only the question layer and the answer sheet layer and he/she can edit only the answer sheet layer to write his/her answer, though a teacher can display all the layers including the correct answer layer to mark or grade. In addition, this invention can be also utilized for the apparatus for presenting design drawings or circuit diagrams.

In order to enhance the security, contents of a specific layer can be preserved into the memory means in an enciphered state. In this case, when collation of password is succeeded, the enciphered contents are decoded and displayed in a recognizable form. However, when collation of password is failed, the enciphered contents are not decoded and displayed in an unrecognizable form.

In practical, the presentation apparatus for two-dimensional picture information according to this invention is realized by installing a particular software program into a general computer. Accordingly, in many cases, the above-described apparatus is developed as software program and this program is provided in a form of data recording medium.

As stated above, in accordance with the presentation apparatus for two-dimensional picture information according to this invention, since the layers are managed by passwords, the respective layers can be handled with security. Further, since the function to synthesize the layers is provided, plural files can be handled in unified manner.

What is claimed is:

1. A presentation apparatus for two-dimensional picture information, comprising:

display means for displaying a predetermined picture in a two-dimensional display area;

memory means for preserving contents to be displayed in said display area as data in a state divided into plural layers; and display control means for reading out data with respect to a designated layer from said memory means in accordance with a layer designation inputted by an operator, preparing a picture to be displayed on the basis of the data which has been read out and delivering the prepared picture to said display means to display it;

wherein said display control means has a function to set a password with respect to a specific layer based on demand of the operator and, when a layer in which the password is set is designated, to display contents of said designated layer in the display area provided that said password is inputted.

2. A presentation apparatus for two-dimensional picture information, comprising:

display means for displaying a predetermined picture in a two-dimensional display area;

memory means for preserving contents to be displayed in said display area as data in a state divided into plural layers;

display control means for reading out data with respect to a designated layer from said memory means in accordance with a layer designation inputted by an operator, preparing a picture to be displayed on the basis of the data which has been read out and delivering the prepared picture to said display means to display it; and editing means for editing data with respect to a designated layer in accordance with a layer designation and an editing instruction inputted by the operator and storing edited data into said memory means;

wherein said editing means has a function to set a password with respect to a specific layer based on demand of the operator and, when a layer in which the password is set is designated, to edit contents of said designated layer provided that said password is inputted.

3. A presentation apparatus for two-dimensional picture information, comprising:

display means for displaying a predetermined picture in a two-dimensional display area;

memory means for preserving contents to be displayed in said display area as data in a state divided into plural layers;

display control means for reading out data with respect to a designated layer from said memory means in accordance with a layer designation inputted by an operator, preparing a picture to be displayed on the basis of the data which has been read out and delivering the prepared picture to said display means to display it; and editing means for editing data with respect to a designated layer in accordance with a layer designation and an editing instruction inputted by the operator and storing edited data into said memory means;

wherein said display control means has a function to set a display password with respect to a specific layer based on demand of the operator and, when a layer in which the display password is set is designated, to display contents of said designated layer in the display area provided that said display password is inputted; and wherein said editing means has a function to set an editing password with respect to a specific layer based on demand of the operator and, when a layer in which the editing password is set is designated, to edit contents of said designated layer provided that said editing password is inputted.

4. A presentation apparatus for two-dimensional picture information as set forth in claim 1:

wherein data of a specific layer is preserved within the memory means in an enciphered state, whereby in the case where collation of the password is succeeded, the data is decoded so that contents of said specific layer are displayed in a state where they can be recognized, while in the case where collation of the password is failed, the data is not decoded so that contents of said specific layer are displayed in a state where they cannot be recognized.

5. A presentation apparatus for two-dimensional picture information as set forth in claim 2, further comprising:

file synthesis means having a function to combine a first file and a second file into a third file;

wherein said first file consists of a first group of data having at least one layer and a second group of data having at least one layer, and said second file consists of a third group of data having at least one layer and a fourth group of data having at least one layer, said first group of data and said third group of data being same; and wherein said file synthesis means produces said third file by gathering said first, second and fourth group of data.

6. A computer readable recording medium on which there is recorded a program for allowing a computer to function as the memory means and the display control means as set forth in claim 1.

7. A computer readable recording medium on which there is recorded a program for allowing a computer to function as the memory means, the display control means and the editing means as set forth in claim 2.

* * * * *